US010074897B2

(12) United States Patent
Le Pennec et al.

(10) Patent No.: US 10,074,897 B2
(45) Date of Patent: Sep. 11, 2018

(54) UNDERWATER RADIO FREQUENCY ANTENNA

(71) Applicant: INSTTUT FRANÇAIS DE RECHERCHE POUR L'EXPLOITATION DE LA MER—IFREMER, Issy-les-Moulineaux (FR)

(72) Inventors: François Le Pennec, Porspoder (FR); Christian Gac, Saint-Renon (FR); Hector Fabian Guarnizo Mendez, Chaparral (CO); Christian Person, Saint-Renan (FR); Ronan Apprioual, Brest (FR); Raymond Jezequel, Locmaria-Plouzane (FR); Serge Pinel, Brest (FR)

(73) Assignee: INSTITUT FRANÇAIS DE RECHERCHE POUR L'EXPLOITATION DE LA MER—IFREMER, Issy-les-Moulineaux (FR)

( * ) Notice: Subject to any disclaimer, the term of this patent is extended or adjusted under 35 U.S.C. 154(b) by 124 days.

(21) Appl. No.: 15/033,399

(22) PCT Filed: Oct. 24, 2014

(86) PCT No.: PCT/EP2014/072912

§ 371 (c)(1),
(2) Date: Aug. 29, 2016

(87) PCT Pub. No.: WO2015/062995

PCT Pub. Date: May 7, 2015

(65) Prior Publication Data

US 2016/0365626 A1 Dec. 15, 2016

(30) Foreign Application Priority Data

Oct. 29, 2013 (FR) ..... 13 60581

(51) Int. Cl.
*H01Q 1/34* (2006.01)
*H01P 7/06* (2006.01)
(Continued)

(52) U.S. Cl.
CPC ..... *H01Q 1/34* (2013.01); *H01P 7/06* (2013.01); *H01Q 1/36* (2013.01); *H01Q 13/02* (2013.01); *H01Q 13/06* (2013.01)

(58) Field of Classification Search
CPC .. H01Q 1/04; H01Q 1/34; H01Q 1/36; H01Q 13/02; H01Q 13/06
See application file for complete search history.

(56) References Cited

U.S. PATENT DOCUMENTS 4,672,387 A 6/1987 Waddoup et al.
6,154,179 A 11/2000 Kohno
(Continued)

FOREIGN PATENT DOCUMENTS

WO 9013927 A1 11/1990

OTHER PUBLICATIONS

International Search Report dated Nov. 14, 2014 re: Application No. PCT/EP2014/072912; pp. 1-2.

*Primary Examiner* — Hoang Nguyen
(74) *Attorney, Agent, or Firm* — Cantor Colburn LLP

(57) ABSTRACT

The present invention relates to an underwater radio frequency antenna able to radiate in an underwater or equivalent propagation medium. It comprises a hollow conducting tube forming a resonant cavity, said conducting tube having an open end and a closed end, means of excitation of said resonant cavity which area able to be fed with signals and are arranged in such a way that the resonant cavity emits an electromagnetic radiation through said open end, at least one layer of dielectric material filling at least partially said resonant cavity so as to close the open end of the resonant
(Continued)

cavity and render said cavity leaktight in relation to the underwater medium and to allow said electromagnetic radiation to pass through.

11 Claims, 2 Drawing Sheets

(51) Int. Cl.

| | |
|---|---|
| ***H01Q 13/02*** | (2006.01) |
| ***H01Q 13/06*** | (2006.01) |
| ***H01Q 1/36*** | (2006.01) |

(56) References Cited

U.S. PATENT DOCUMENTS

| | | | | |
|---|---|---|---|---|
| 8,604,986 | B2 * | 12/2013 | Lucas | H04B 13/02 343/709 |
| 2009/0262038 | A1 | 10/2009 | Gerding et al. | |

* cited by examiner

UNDERWATER RADIO FREQUENCY ANTENNA

FIELD OF THE INVENTION

The present invention relates to the field of underwater communication systems and more particularly to antennas used in underwater communication systems communicating by radio waves or electromagnetic signals. The invention relates more particularly to an underwater radio frequency antenna.

STATE OF THE RELATED ART

The use of electromagnetic waves as a medium for transmitting a message in the sea is long-standing as this principle was the subject of patent No. 1242 filed in the United Kingdom in 1854 by Lord Lindsay and entitled "A Mode of Transmitting Messages by Means of Electricity through and across a Body or Bodies of Water", in the context of the transatlantic links under development at that time.

Transmission between conventional and subsequently strategic submarines, the operation of underwater resources (gas, oil in particular), the development of oceanography, represent the main driving forces behind the development of underwater radio communications. As mentioned by R. K. Moore in the document entitled "Radio communication in the sea", Spectrum, IEEE, vol. 4 , no. 11, p. 42-51, 1967 , long distances can only be attained using very low frequencies (ELF and VLF, up to a few tens of kHz), resulting in very large antennas and very low rates due to the small bandwidth and very high atmospheric radio noise at low frequencies. Moore mentions that it is easier to communicate from land with a man on the moon than from the water surface to a deeply immersed submarine at distances of 100 km under these conditions.

In the document entitled "Electromagnetic propagation between antennas submerged in the ocean", Antennas and Propagation, IEEE Transactions on, vol. 21, no. 4 , p. 507-513, 1973 , Siegel & al. publish underwater radio transmission measurements at 100 KHz and 14 MHz. The respective experimental ranges obtained are approximately 16 m and 5 m, but no data transmission is described in the article. The transmission and reception antennas used are dipole antennas.

The document "Equations for Calculating the Dielectric Constant of Saline Water", by A. Stogryn, Microwave Theory and Techniques, IEEE Transactions on, vol. 19 , no. 8 , p. 733-736, 1971 is an article describing an empirical mathematical model for electromagnetic wave attenuation in seawater, based on critical parameters: salinity, temperature and frequency. This model makes it possible to envisage the configurable design of radiant devices in seawater. Further models would subsequently be published, such as that described in the document "An improved model for the dielectric constant of sea water at microwave frequencies", by L. Klein and C. T. Swift, IEEE Transactions on Antennas and Propagation, vol. 25 , no. 1 , p. 104-111, 1977 or that by R. Somaraju and J. Trumpf based on an electrophysiological approach of saltwater and described in the document "Frequency, Temperature and Salinity Variation of the Permittivity of Seawater", Antennas and Propagation, IEEE Transactions on, vol. 54, no. 11 , p. 3441-3448, 2006.

The use of modern underwater antennas is described in the document "Propagation of electromagnetic waves at MHz frequencies through seawater", by A. I. Al-Shamma'a, A. Shaw, and S. Saman, Antennas and Propagation, IEEE Transactions on, vol. 52 , no. 11 , p. 2843-2849, 2004, with frequencies of the order of the MHz and experiments on the Liverpool docks in England. The antennas described are based on wired technology and consist of resonant loops, with horizontal ranges of up to 85 m in shallow water.

The company Wireless Fiber and Systems Technologies (WFS) has developed this immersed wired antenna technology (loops, monopoles, dipoles) and marketed worldwide the first underwater radio modems using this technology.

SUMMARY OF THE INVENTION

In this context, the aim of the invention is that of addressing the need for high-speed data transmission, for example real-time or pre-recorded video data, or measurement data, without any contact between two devices immersed in the sea, which may not be perfectly stabilised.

One aim of the invention is thus that of proposing an underwater radio frequency antenna which can be used for contactless data transmission between two immersed devices, at least one whereof is equipped with this antenna.

A further aim of the invention is that of proposing an antenna with a low sensitivity to variations in sea conditions, particularly to variations in pressure, salinity, and temperature.

For this purpose, the invention relates to an underwater radio frequency antenna adapted to radiate in an underwater propagation medium, comprising

- a hollow conducting tube forming a resonant cavity, said conducting tube having an open end and a closed end,
- means for the excitation of said resonant cavity suitable for being fed with signals and arranged in such a way that the resonant cavity emits an electromagnetic radiation through said open end,
- at least one layer of dielectric material filling at least partially said resonant cavity so as to close the open end of the resonant cavity and render said cavity leaktight in relation to the underwater medium, said layer being suitable for resisting the pressure of the underwater medium and allowing said electromagnetic radiation to pass through.

According to the invention, the antenna generates a radio frequency using a resonant cavity open at one of the ends thereof and excited by excitation means, the inside of the resonant cavity being insulated from the underwater medium by at least one layer of dielectric material filling the cavity at the open end thereof.

The layer of dielectric material partially or completely fills the resonant cavity.

According to one particular embodiment, the operating frequency is within the frequency band [10 MHz-10 GHz], situated preferably around 2.4 GHz so as to be compatible with ISM frequencies and notably the IEEE 802.11g Wi-Fi communication standard or the subsequent upgrades thereof situated in the same ISM frequency bands.

According to one particular embodiment, the conducting tube has an overall cylindrical shape so as to form an antenna with a circular opening, and the radius of the conducting tube and/or the relative permittivity of the dielectric material are determined to set the nominal frequency of the radiation.

Indeed, there are two possible viewpoints for selecting the radius of the tube and the permittivity value of the dielectric material: if the layer of dielectric material is used as a mere leak-tightness cover for the cavity, then the permittivity characteristics thereof and the dimensions thereof are chosen so as not to disturb the frequency excessively while withstanding the pressures; it is also possible to use the layer of dielectric material to reduce the overall size of the antenna; in this case, the permittivity value of the layer of dielectric material and the radius of the cavity are determined to set the frequency of the electromagnetic radiation.

Further tube shapes are possible, such as tubes having an elliptical, square, rectangular or more generally polygonal cross-section.

According to one particular embodiment, the conducting tube having a longitudinal axis of symmetry, the means for the excitation of the resonant cavity are arranged along said longitudinal axis of symmetry of the conducting tube so as to excite the cavity by an azimuthal symmetry cavity mode. The azimuthal symmetry cavity mode is for example similar to the $TM_{010}$ mode of a metal cavity.

According to one particular embodiment, the means for excitation of the resonant cavity include a probe connected by one of the ends thereof, or first end, to a signal supply cable via an orifice in the wall of the resonant cavity.

The orifice is advantageously formed substantially at the centre of the wall of the closed end of the conducting tube in such a way that the probe is substantially positioned on the axis of symmetry of the conducting tube.

According to one particular embodiment, the probe has, at a second end corresponding to the free end of the probe, a so-called transition element having for example an overall inverted triangle shape wherein the vertex is connected to said second end. Alternatively, the transition element has a planar polygonal (trapezium, oar, ellipse, etc.) or volumetric shape by rotating these planar shapes about the axis of the cavity (for example, truncated cone).

According to a further particular embodiment, the probe is a resonant element coupled with the cavity. The length thereof inside the cavity is then comparable with that of a monopole (quarter-wave) disturbed by the cavity.

In the basic embodiment, the antenna comprises a layer of dielectric material partially or completely filling the resonant cavity. According to one particular embodiment, the antenna comprises a plurality of layers of dielectric material in the tube. It comprises at least first and second overlaid layers of dielectric material at least partially filling said resonant cavity, the dielectric material of said first layer being different than that of said second layer.

The invention also relates to a radio frequency device suitable for emitting electromagnetic radiation through an underwater propagation medium, comprising an antenna connected to a modem, characterised in that the antenna is as defined above.

Further advantages may emerge for those skilled in the art on reading the examples hereinafter, illustrated by the appended figures, given by way of illustration.

DETAILED DESCRIPTION OF THE INVENTION

The invention will be more particularly described in the context of an antenna with a resonant cavity having a circular opening wherein the resonant cavity is excited by a resonant mode wherein the fields are only dependent on the radial position in question (and not on the azimuth or the height), which is similar to the $TM_{010}$ transverse magnetic mode known for a closed empty cylindrical metal cavity. Hereinafter in the description, this resonant mode will be referred to as $TM_{010}$ mode in view of the proximity between the configuration of the electromagnetic fields thereof and those of $TM_{010}$ mode for a closed empty metal cavity. This proximity is especially obvious as the conductivity of the seawater in question is high.

Figure 1:
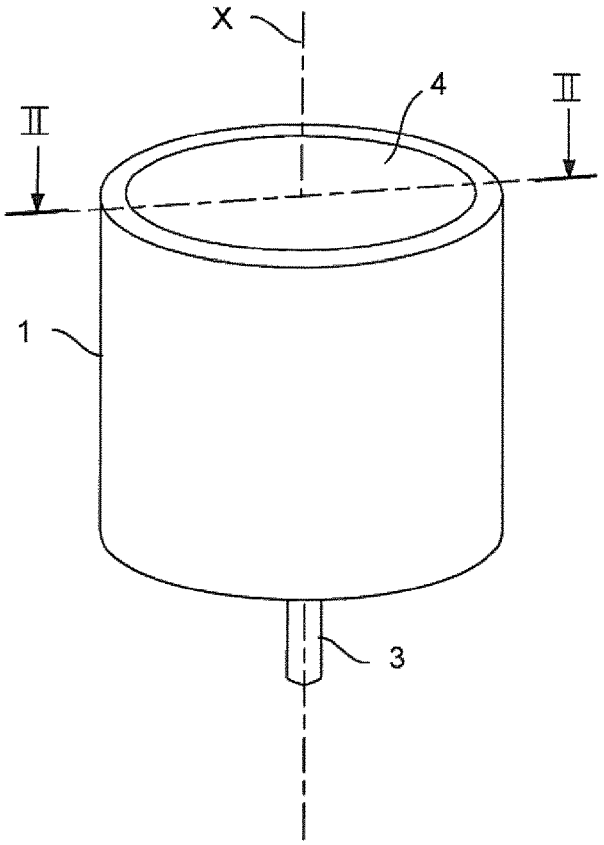
FIG. 1 represents a schematic perspective view of an antenna according to a first embodiment of the invention.
Figure 2:
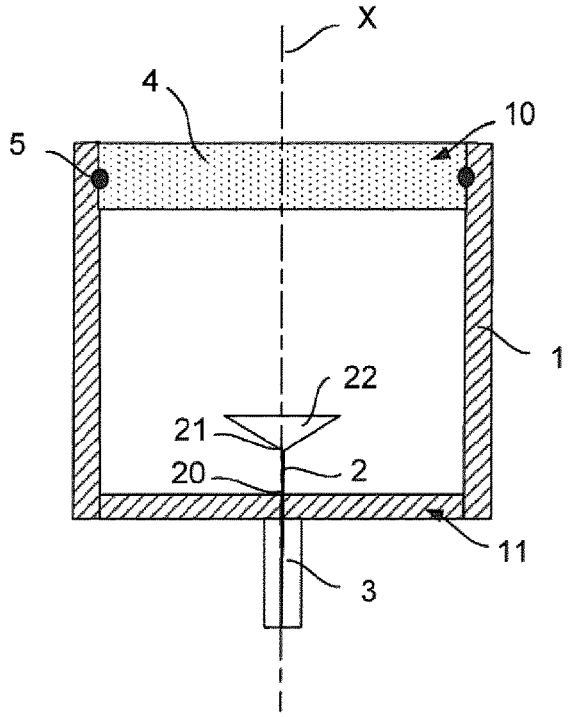
FIG. 2 represents a sectional view of the antenna in FIG. 1 along the section II-II.

With reference to FIGS. 1 and 2, the underwater radio frequency antenna comprises a hollow tube 1 made of conductive material having an open end 10 and a closed end 11. This tube, made for example of non-oxidising metal, is intended to form a resonant cavity. The tube 1 has an overall cylindrical shape and has a longitudinal axis of symmetry X.

Excitation means are arranged in the resonant cavity for exciting same. The excitation means comprise a probe 2 wherein one end 20 is connected to a signal supply cable 3. This cable is for example a coaxial cable. The core of the coaxial cable is then connected to the probe.

The probe 2 is fed with signals by the cable 3 and is positioned at the centre of the wall of the closed end 11 of the tube in such a way that the resonant cavity emits an electromagnetic radiation through the open end 10. A bore is formed in the wall of the closed end 11 to allow the passage of the cable 3 or a cable/probe transition.

The other end 21 of the probe 2 is equipped with a so-called transition element 22 having the shape of an inverted triangle wherein the vertex is connected to the end 21. The role of the transition element is that of optimising the transition of the cavity.

The tube 1 is partially filled with a layer 4 of dielectric material so as to close the open end 10 of the resonant cavity and render same leaktight with respect to the underwater medium. For the remainder, the tube is filled with air. The layer 4 is chosen so as to resist the pressure of the underwater medium, this pressure obviously being dependent on the depth at which the antenna is used. The layer 4 has also been chosen so as not to reduce the radiation of the cavity. The height thereof, the constituent material thereof and the shape of the interfaces thereof with the inside and outside of the cavity may be modified to obtain specific properties for focussing the radiation or facilitate the adaptation of the antenna.

The dielectric material is for example PVC, HDPE, polypropylene or glass. An annular seal 5 is advantageously arranged in the cavity, at the open end 10 of the tube, to reduce the risk of a lack of leak-tightness of the cavity with respect to the propagation medium. In this $TM_{010}$ mode, the higher the permittivity of the dielectric material, the greater the possibility of reducing the radius of the cavity when the dielectric material fills the cavity completely.

This antenna, having an overall cylindrical shape, has a circular opening and radiates through this opening.

According to the invention, the constituent elements of the antenna are positioned and designed in such a way that the electromagnetic radiation emitted by the antenna has a frequency with a low sensitivity to the variability of the sea conditions. The choice of $TM_{010}$ mode requires a resonance frequency which is essentially dependent on the radius of the cavity, and therefore not particularly on the salinity conditions at the open end.

According to one preferred embodiment, the antenna is designed to be in the 2.4 GHz ISM band. If the dielectric material fills a large majority of the cavity, the radius of the tube 1 and the relative permittivity of the dielectric material are then determined to set the nominal frequency of the radiation at this operating frequency.

Such an antenna radiating at 2.46 GHz and operating based on $TM_{010}$ mode has been embodied, said antenna having the following features:

cylindrical tube made of non-oxidising treated metal;
PVC dielectric layer having a permittivity $\in_r=3$;
probe centred on the axis of symmetry of the tube;
radius of the cavity: 47.03 mm;
height of the cavity: 200 mm;
thickness of the dielectric layer: 40 mm;
triangular transition element;
width of triangle: 25.97 mm;
height of triangle: 5.17 mm; and
length of the probe between the coaxial cable and the triangular transition: 4 mm.

The position of the probe (centred or off-centred with respect to the tube axis), the length thereof (distance of transition with respect to the closed end), the shape (triangular, conical, annular, etc.) and the dimensions of the transition element may vary and are defined for optimal excitation of the electromagnetic wave at the target operating frequency, while making it possible to optimise the properties chosen for the antenna: antenna gain or factor, polarisation, variable focus of the radiation, bandwidth.

In the example in FIGS. 1 and 2, the cylindrical shape of the tube and the use of a planar probe centred on the axis of symmetry of the tube with a triangular transition makes it possible to excite the cavity with an azimuth-invariant resonant mode, for example $TM_{010}$ mode.

This avoids any angular positioning constraint in the plane orthogonal to the axis of symmetry of the tube following a transmission between two antennas of the same type (invariance of azimuth polarisation).

It is possible to excite the resonant cavity with a resonant mode with no radial symmetry by changing the position of the probe and the shape of the transition t to, in exchange, enhance various features of the antenna (antenna gain or factor, bandwidth, etc.). In this embodiment, it is advisable optionally to add a circular polarisation mechanism to retain the lack of angular positioning constraint.

The positioning of the probe in the tube and the shape of the transition element thereof may also be modified so as to partially excite a plurality of adjacent resonant modes wherein the coupling is dependent on the operating frequency, in order to set the bandwidth of the antenna. For example the use of a probe which is resonant per se may, by coupling with the radiant cavity, naturally increase the bandwidth. For example a probe in the shape of a truncated cone wherein the wider base is situated on the side of the opening of the cavity and wherein the length is similar to that of a quarter-wave monopole at the central operating frequency will enable such an embodiment. The cavity and the probe both being resonant on the frequencies very close to the central operating frequency chosen, the mutual coupling thereof will induce a broadening of the bandwidth according to usual coupled resonator behaviour.

Further transition shapes have also been favourably tested. A transition having an overall oar shape made it possible to extend the bandwidth of the antenna with respect to the triangular shape. Transitions having an overall truncated shape have also been favourably tested.

It is also possible to envisage the use of a plurality of probes to excite a plurality of resonant modes of the cavity. In this case, the bores (or orifices) required to connect the probes may then be formed in the peripheral wall of the tube. For example, a probe in the shape of a suitably sized loop situated in the cross-sectional plane inside the cavity makes it possible to excite the $TM_{010}$ mode by magnetic coupling, whereas the triangular probe situated at the centre of the cavity favours the electrical coupling thereof.

The operating frequency of this antenna has, by design, a very low sensitivity to the variability of the conditions of underwater environments (pressure, salinity, temperature, turbidity, etc.), because the tubular resonant cavity sets this operating frequency and only the radiant opening thereof is in contact with this propagation medium. As such, operating with freshwater or saltwater only significantly changes the possible range for a cylindrical cavity antenna excited according to $TM_{010}$ mode, said range being dependent on the natural attenuation of the radio waves in these different media.

Figure 3:
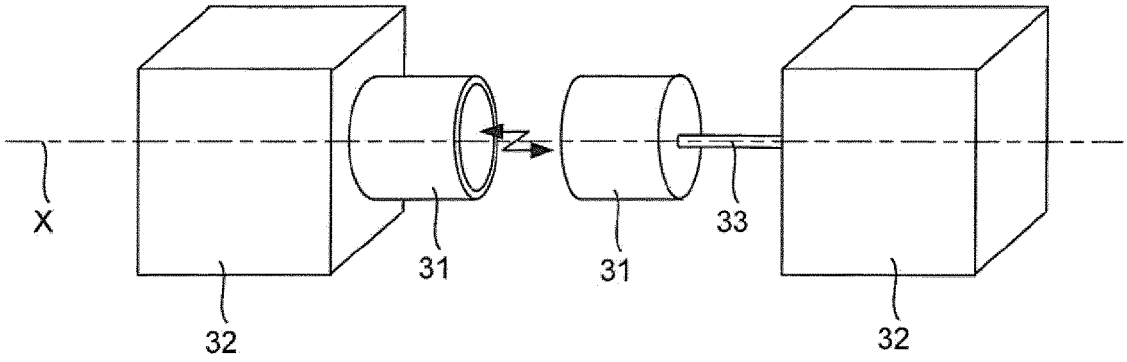
FIG. 3 represents a schematic view of two devices equipped with antennas according to FIG. 1 in operating conditions.

FIG. 3 shows a simplified diagram of two remote underwater devices exchanging data via radio. They are each equipped with an antenna 31 as defined above, previously connected, directly or via a cable 33, to a modem 32. The antennas are aligned in such a way that the longitudinal axes X thereof merge. The use of an azimuthal-symmetry resonant mode makes it possible obtain a transmission which tolerates misalignment or instability between the transmitting antenna and the receiving antenna. The modem is for example a radio modem complying with the IEEE 802.11g Wi-Fi communication standard. It is then possible to obtain speeds of up to 54 Mbit/s.

The first measurements on a prototype demonstrated a bandwidth of approximately 70 MHz about the 2.4 GHz frequency and a range between 10 and 15 cm in standard seawater at ambient temperature and up to 25 cm in freshwater at ambient temperature.

The limitation of the range is essentially due to the high attenuation of radio waves in the propagation medium at the frequencies used (2.4 GHz).

Figure 4:
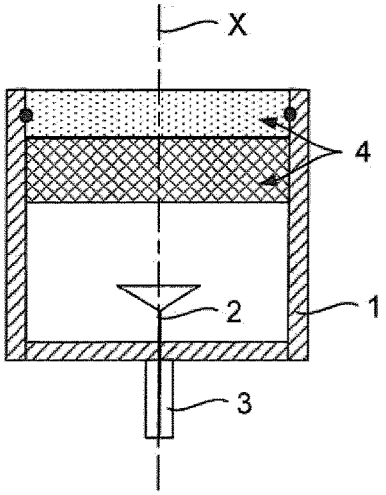
FIG. 4 represents a schematic sectional view of a second embodiment of the invention.

The embodiment illustrated in FIGS. 1 and 2 has an antenna comprising a tube 1 having an overall cylindrical shape partially filled with a layer 4 of dielectric material. Alternatively, the tube 1 may comprise a plurality of overlaid dielectric layers as illustrated in FIG. 4, said layers having different permittivities. This makes it possible for example to use a hydrophobic material for the upper dielectric layer and a material that is not necessarily hydrophobic for the lower layers, in order to minimise the production costs of the antenna while optimising certain electrical properties of the antenna (adaptation, bandwidth, focus of radiation) or mechanical properties (resistance to pressure).

The embodiments described above have been given by way of example. It is obvious for a person skilled in the art that they can be modified, particularly in terms of the shape of the cavity, the probe and the permittivity of the dielectric layer.

Moreover, it is obvious that the antenna described herein can communicate with a standard radio antenna operating on the same frequency. It could for example communicate with a standard antenna situated inside an undersea vessel wherein the wall is adapted to allow electromagnetic radiation to pass through (for example a window).

The invention claimed is:

1. Underwater radio frequency antenna adapted to radiate in an underwater propagation medium, characterised in that it comprises a hollow conducting tube forming a resonant cavity, said conducting tube having an open end and a closed end,
means for the excitation of said resonant cavity suitable for being fed with signals and arranged in such a way that the resonant cavity emits an electromagnetic radiation through said open end, at least one layer of dielectric material filling at least partially said resonant cavity so as to close the open end of the resonant cavity and render said cavity leaktight in relation to the underwater medium, said layer being suitable for resisting the pressure of the underwater medium and allowing said electromagnetic radiation to pass through.

2. Antenna according to claim 1, wherein the operating frequency is within the frequency band 10 MHz-10 GHz.

3. Antenna according to claim 1, wherein the conducting tube has an overall cylindrical shape so as to form an antenna with a circular opening, and the radius of the conducting tube and/or the relative permittivity of the dielectric material are determined to set the nominal frequency of the electromagnetic radiation.

4. Antenna according to claim 1, wherein the conducting tube has a longitudinal axis of symmetry (X) and in that the means for the excitation of the resonant cavity are arranged along said longitudinal axis of symmetry of the conducting tube so as to excite the cavity by an azimuthal symmetry cavity mode.

5. Antenna according to claim 4, wherein the azimuthal symmetry cavity mode is $TM_{010}$ mode.

6. Antenna according to claim 4, wherein the means for excitation of the resonant cavity include a probe connected by one of the ends thereof, or first end, to a signal supply cable via an orifice in the wall of the resonant cavity.

7. Antenna according to claim 6, wherein said orifice is formed substantially at the centre of the wall of the closed end of the conducting tube in such a way that the probe is substantially positioned on the axis of symmetry of the conducting tube.

8. Antenna according to claim 6, wherein the probe has, at a second end, a so-called transition element having an overall inverted triangle shape wherein the vertex is connected to said second end.

9. Antenna according to claim 6, wherein the probe is a resonant element coupled with the cavity.

10. Antenna according to claim 1, further comprising at least first and second overlaid layers of dielectric material at least partially filling said resonant cavity, the dielectric material of said first layer being different than that of said second layer.

11. Radio frequency device suitable for emitting electromagnetic radiation through an underwater propagation medium, comprising an antenna connected to a modem, wherein the antenna is according to claim 1.

* * * * *